US008939813B2

(12) United States Patent
Kronberger et al.

(10) Patent No.: US 8,939,813 B2
(45) Date of Patent: Jan. 27, 2015

(54) TOYS IMPLEMENTING INDUCTIVELY COUPLED POWER TRANSFER SYSTEMS

(75) Inventors: Warren Kronberger, Lombard, IL (US); Benjamin Poate, London (GB); Francis Ng, Hong Kong (CN)

(73) Assignee: The Marketing Store Woldwide, LP, Chicago, IL (US)

( * ) Notice: Subject to any disclaimer, the term of this patent is extended or adjusted under 35 U.S.C. 154(b) by 173 days.

(21) Appl. No.: 13/417,948

(22) Filed: Mar. 12, 2012

(65) Prior Publication Data

US 2012/0231699 A1 Sep. 13, 2012

Related U.S. Application Data

(60) Provisional application No. 61/451,882, filed on Mar. 11, 2011.

(51) Int. Cl.
*A63H 29/22* (2006.01)

(52) U.S. Cl.
CPC ..... *A63H 29/22* (2013.01)
USPC ..... 446/484

(58) Field of Classification Search
USPC ..... 446/91, 219, 236, 242, 270, 293, 294, 446/295, 297, 322, 358, 397, 457, 484
See application file for complete search history.

(56) References Cited

U.S. PATENT DOCUMENTS

| | | | | |
|---|---|---|---|---|
| 3,888,233 | A * | 6/1975 | Ware | 600/28 |
| 4,678,450 | A * | 7/1987 | Scolari et al. | 446/405 |
| 5,742,486 | A * | 4/1998 | Yangkuai | 361/807 |
| 6,568,980 | B2 * | 5/2003 | Barthold | 446/36 |
| 7,872,850 | B2 * | 1/2011 | Pelrine et al. | 361/234 |
| 8,133,089 | B2 * | 3/2012 | Amireh et al. | 446/58 |
| 8,171,875 | B1 * | 5/2012 | Caldwell et al. | 116/22 A |
| 8,337,274 | B1 * | 12/2012 | Wong | 446/454 |
| 2005/0042974 | A1 * | 2/2005 | Agostini et al. | 446/272 |
| 2008/0014835 | A1 * | 1/2008 | Weston et al. | 446/484 |

* cited by examiner

*Primary Examiner* — Kurt Fernstrom
(74) *Attorney, Agent, or Firm* — William J. McNichol, Jr.; Reed Smith LLP

(57) ABSTRACT

Electronic toys have now been around for years and are powered through mechanisms that require a toy to be tethered to a cable or utilize conventional batteries. Such toys are inconvenient because they consume a user's time to re-charge them, which in turn also limits the utility of these toys. Embodiments of this invention implement toys using an inductively coupled power transfer system, which is a wireless mechanism that is convenient to use and provides a faster way for the user to re-charge the toy. Some embodiments include an electronic device comprising an inductive charging plate, and a toy comprising an internal charge pad, a storage capacitor set to a predetermined voltage level, and a discharging device that discharges a function to implement the toy.

10 Claims, 2 Drawing Sheets

TOYS IMPLEMENTING INDUCTIVELY COUPLED POWER TRANSFER SYSTEMS

CROSS REFERENCE

This application claims priority to U.S. Provisional Application No. 61/451,882 filed Mar. 11, 2011, which is hereby incorporated by reference in its entirety.

FIELD OF INVENTION

This invention relates generally to electronic devices and relates particularly to an electronic toy which can be implemented using an inductively coupled power transfer system.

BACKGROUND OF THE INVENTION

Over the course of time toys have been modified to keep up with technology and needs of the children and adults of that time.

In recent years, sophisticated electronic toys have come on the scene including, USB-based toys. Such toys require tethered charging via a USB cable attached to either a computer or power adapter. As a consequence, the tethered charging requirement limits the utility and convenience of such USB-based toys. Additionally, the tethered charging requirement is time consuming and is also a limiting factor for traveling with such toys.

Other electronic toys depend on known conventional batteries, which can render a toy completely inoperable when they run flat and require replacements on a frequent basis.

BRIEF SUMMARY OF THE INVENTION

The present invention may be constructed and implemented using an inductive charging plate and a toy comprising a charge pad, preferably located internally within the toy, a storage capacitor set to a predetermined voltage level, a discharging device, and a mechanism that makes the toy perform. In the present invention, the charging plate inductively couples with the toy's internal charge pad which induces a voltage in the internal charge pad. This induced voltage is stored by a storage capacitor to a predetermined voltage level, and this stored energy is subsequently discharged by a discharging device. After discharging the storage capacitor, the discharging device then relays a current to wirelessly power a mechanism that makes the toy perform. The present invention offers a significant advantage in that it does not require known wired mechanisms such as USB cable or known conventional batteries to power the toy's performance. The toy's functionality and utility is also expanded because it can be rapidly re-charged through the use of this wireless mechanism.

The toy's mechanism is selected from a group consisting of an electromechanical mechanism, a light-emitting diode, a sound module, and combinations of any thereof.

The present invention can be constructed and implemented in a way in which the storage capacitor repeats the process of receiving and storing the induced voltage from the internal charge pad until it returns to its predetermined voltage level. This embodiment of the invention further allows the discharge device to repeatedly discharge the storage capacitor and repeatedly relay a current to the toy's mechanism, which then allows the toy to perform for an extended period of time.

Embodiments of this invention are described throughout the specification and are not limited to this brief summary.

DETAILED DESCRIPTION OF THE INVENTION

Figure 1:
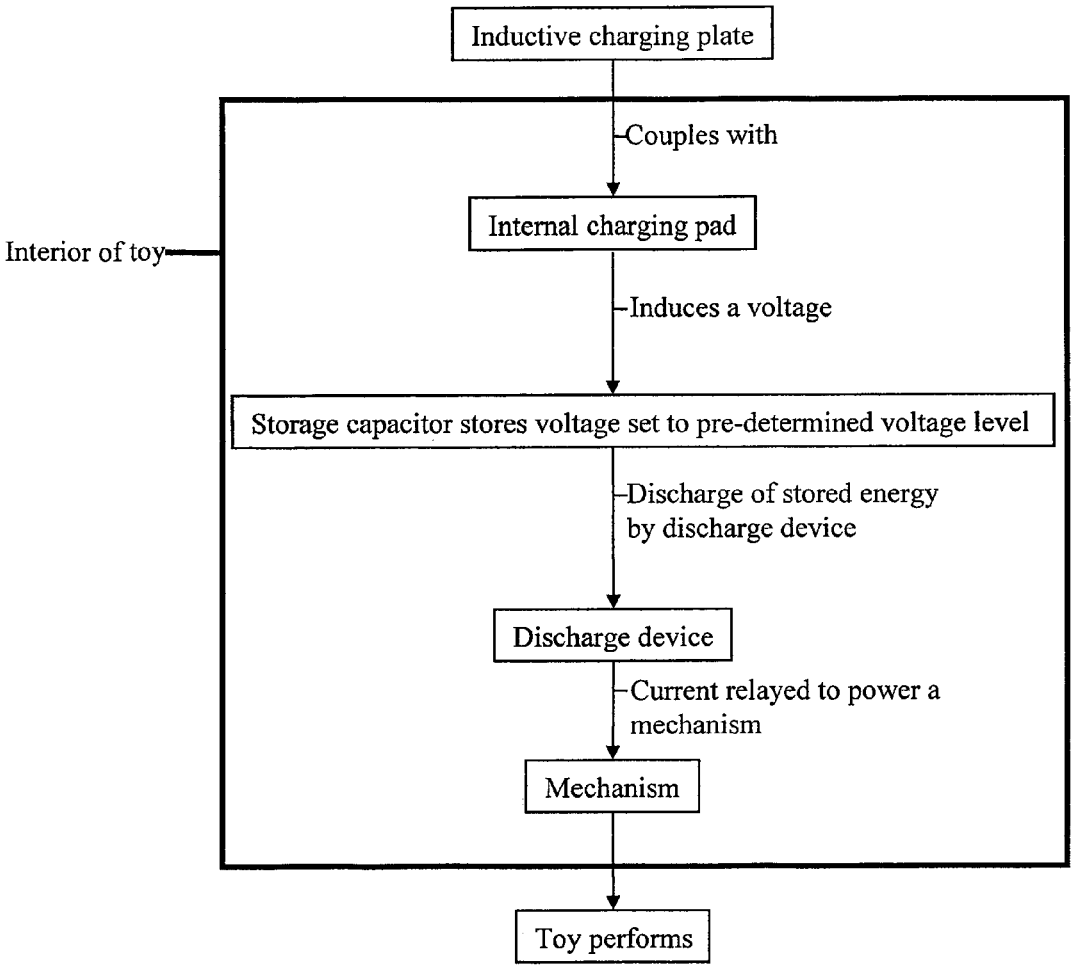
FIG. 1 shows an embodiment of the electronic device with an inductive charging plate and a toy comprising of an internal charging pad, a storage capacitor set to a predetermined voltage, a discharge device, and a mechanism.
Figure 2:
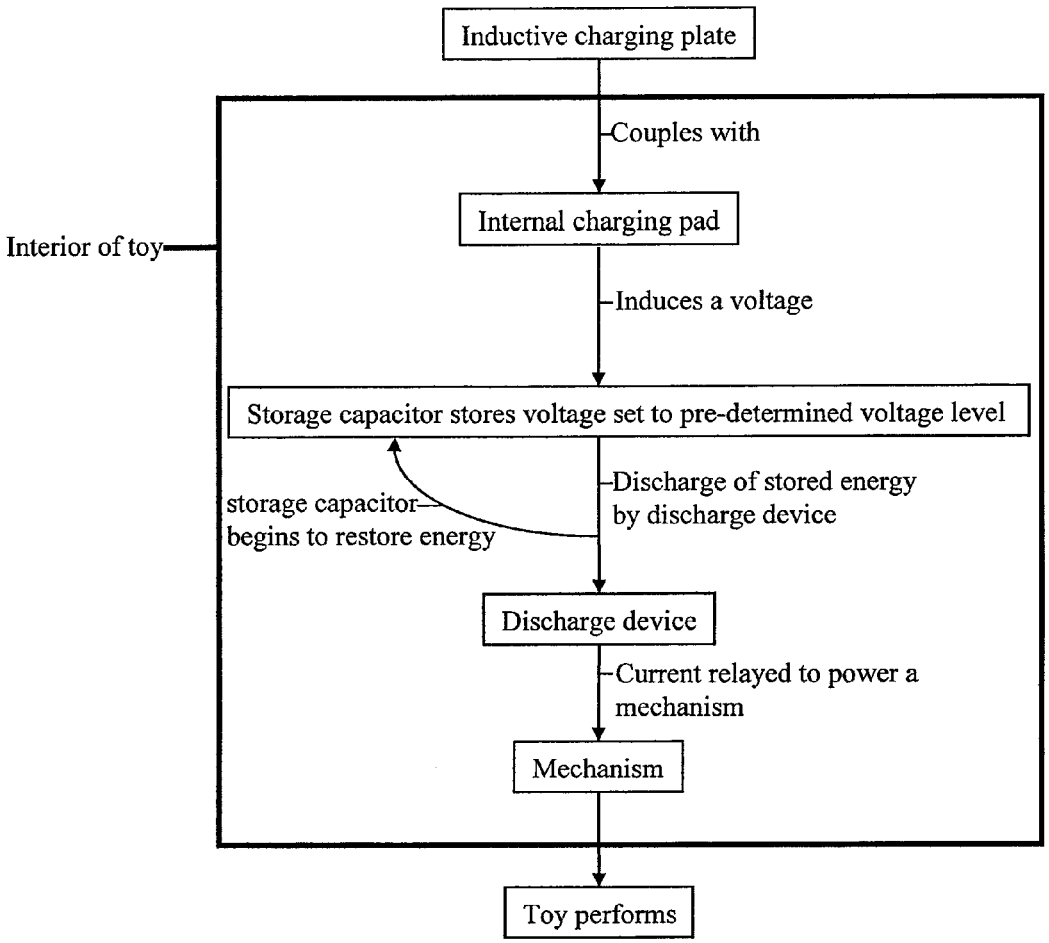
FIG. 2 shows an embodiment of the electronic device with an inductive charging plate and a toy comprising of an internal charging pad, a storage capacitor which repeatedly stores energy to a predetermined voltage, a discharge device, and a mechanism.

The present invention may be embodied in other specific forms without departing from its essential characteristics. The described embodiments are to be considered in all respects only as illustrative and not as restrictive.

The electronic device is constructed by using an inductively coupled power transfer system. Methods and techniques for creating an inductively charged power transfer system are well established and known in the art. It is easy and convenient to charge and re-charge the toy through the inductively coupled power transfer system, which is a wireless mechanism. The toy's functionality and utility is also expanded because it can be rapidly re-charged through the use of this wireless mechanism. The toy and charging plate comprising the electronic device are also mobile and easy to transport.

One embodiment of the invention includes an inductive charging plate, and a toy which includes, an internal charging pad, a storage capacitor set to a predetermined voltage level, a discharge device that discharges the storage capacitor, and a mechanism that is triggered when a current is relayed by the discharge device following the discharge of the storage capacitor.

In certain embodiments of the electronic device, the known inductive charging plate is a conductor consisting of a wire through which a current can flow. In some embodiments, the inductive charging plate consists of an inductive coiled wire which creates an alternating electromagnetic field from within the charging plate. For example, in some embodiments, the known inductive charging plate is a Qi-based charging station. The Qi-based charging station was developed by the Wireless Power Consortium, which is a commercial leader in setting the standards for interoperable wireless charging.

The electronic device includes at least one internal charge pad located within the toy that is the main component responsible for receiving the electromagnetic energy generated by the inductive charging plate. In certain embodiments, the known internal charge pad is a conductor consisting of a wire through which the flow of current from the charging plate induces a voltage. In one embodiment, the known internal pad is an inductive coil in which a voltage is induced by the alternating electromagnetic field of the charging plate's inductive coil.

Certain embodiments of the device include a storage capacitor. In some embodiments, the storage capacitor is any device capable of receiving and storing the induced voltage as energy to a predetermined voltage level. In one embodiment, the known storage capacitor is a passive two-terminal electrical component that receives from the internal charging pad the induced voltage and stores it as energy until it reaches a predetermined voltage.

In certain embodiments, the discharge device is any device that is suitable for receiving the stored voltage from the storage capacitor and then relaying a current for the purpose of triggering a mechanism. In some embodiments the known discharge device is a relay which uses an electromagnet to mechanically switch on the toy's mechanism. In certain embodiments of the device, the known discharge device is a transistor which is used to switch on a mechanism after discharging the storage capacitor. In one embodiment, the known discharge device is a bipolar transistor that becomes saturated after discharging the storage capacitor, and then relays a current to turn on the toy's mechanism.

In certain embodiments, each time the storage capacitor reaches its predetermined voltage and is discharged by the discharge device, it then repeats the process of receiving and storing the induced voltage from the internal charging pad until it returns to its predetermined voltage level. In some embodiments, the storage capacitor receives the induced voltage from the internal charge pad cyclically and is discharged by the discharge device cyclically. In further embodiments, the discharge device relays a current to power the toy's mechanism cyclically. In one embodiment, the storage capacitor receives the induced voltage from the internal charge pad continuously and is discharged by the discharge device continuously. In still further embodiments, the discharge device continuously relays a current to power the toy's mechanism.

In some embodiments of the electronic device after the storage capacitor is discharged, the current relayed by the discharge device powers a known mechanism selected from the group consisting of an electromechanical mechanism, a light-emitting diode, a sound module, and combinations of any thereof. As discussed above, in certain embodiments after the storage capacitor is discharged, the current relayed by the discharge device repeatedly powers a known mechanism selected from the group consisting of an electromechanical mechanism, a light-emitting diode, a sound module, and combinations of any thereof.

In certain embodiments after the storage capacitor is discharged, the current relayed by the discharge device powers an electromechanical mechanism selected from the known group consisting of electronic motors, coils, piezo actuators, and combinations of any thereof. In some embodiments the toy performs a known task selected from the group consisting of walking, hopping, jumping, rolling, spinning, waving, and combinations of any thereof. As discussed above, in further embodiments the toy repeatedly performs a known task selected from the group consisting of walking, hopping, jumping, rolling, spinning, waving, and combinations of any thereof.

In some embodiments after the storage capacitor is discharged, the current relayed by the discharge device powers a known light emitting diode ("LED"). In certain embodiments, the toy produces an illumination selected from the known group consisting of flashing, blinking, lighting effects, and combinations of any thereof. As discussed above, in further embodiments the toy repeatedly produces an illumination selected from the group consisting of flashing, blinking, lighting effects, and combinations of any thereof.

In certain embodiments after the storage capacitor is discharged, the current relayed by the discharge device powers a known sound module. In some embodiments, the toy produces a sound selected from the known group consisting of predetermined words, musical sound, effect sounds, and combinations of any thereof. As discussed above, in further embodiments, the toy repeatedly produces a sound selected from the group consisting of predetermined words, musical sound, effect sounds, and combinations of any thereof.

We claim:

1. An electronic device comprising:

a) an inductive charging plate;

b) a toy comprising:

i. a charge pad, wherein said charge pad inductively couples with said inductive charging plate and induces a voltage in said charge pad;

ii. a storage capacitor, wherein said storage capacitor is operatively connected to said charge pad, and wherein said charge pad delivers said voltage to said storage capacitor until said storage capacitor reaches a predetermined voltage;

iii. a discharge device, wherein said discharge device is operatively connected to said storage capacitor, and wherein said discharge device discharges said storage capacitor once said storage capacitor reaches a predetermined voltage; and iv. a mechanism, wherein said mechanism is powered by the discharge of the storage capacitor to said mechanism following said storage capacitor's discharge by the discharge device.

2. The electronic device of claim 1, wherein said storage capacitor repeatedly stores said voltage to its predetermined voltage level upon the discharge of said storage capacitor by said discharge device.

3. The electronic device of claim 2, wherein the mechanism is selected from the group consisting of an electromechanical mechanism, a light-emitting diode, a sound module, and combinations of any thereof.

4. The electronic device of claim 3, wherein the discharge of said storage capacitor and the relay of a current by the discharge device repeatedly powers a mechanism selected from the group consisting of an electromechanical mechanism, a light-emitting diode, a sound module, and combinations of any thereof.

5. The electronic device of claim 2, wherein said mechanism is an electromechanical mechanism selected from the group consisting of electronic motors, coils, piezo actuators, and combinations of any thereof.

6. The electronic device of claim 5, wherein said toy performs a task selected from the group consisting of walking, hopping, jumping, rolling, spinning, waving, and combinations of any thereof.

7. The electronic device of claim 2, wherein said mechanism is a light-emitting diode (LED) that produces an illumination selected from the group consisting of flashing, blinking, lighting effects, and combinations of any thereof.

8. The electronic device of claim 2, wherein said mechanism is a sound module that produces a sound selected from the group consisting of predetermined words, musical sound, effect sounds, and combinations of any thereof.

9. An electronic device comprising:

a) a toy comprising:

i. a charge pad, wherein said charge pad inductively couples with said inductive charging plate and induces a voltage in said charge pad, the charge pad being located internally within the toy;

ii. a storage capacitor, wherein said storage capacitor is operatively connected to said charge pad, and wherein said charge pad delivers said voltage to said storage capacitor until said storage capacitor reaches a predetermined voltage;

iii. a discharge device, wherein said discharge device is operatively connected to said storage capacitor, and wherein said discharge device discharges said storage capacitor once said storage capacitor reaches a predetermined voltage; and iv. a mechanism, wherein said mechanism is powered by the discharge of the storage capacitor to said mechanism following said storage capacitor's discharge by the discharge device;

b) an inductive charging plate selected from the group consisting of a wire through which a current can flow, an inductive coiled wire which creates an alternating electromagnetic field, a Qi-based charging station, and combinations of any thereof, the inductive charging plate being positioned exterior of the toy.

10. The electronic device of claim 9, wherein the inductive charging plate is a Qi-based charging station.

* * * * *